US007387427B2

(12) United States Patent
Chiang et al.

(10) Patent No.: US 7,387,427 B2
(45) Date of Patent: Jun. 17, 2008

(54) METHOD FOR BLENDING HEAT-SENSITIVE MATERIAL USING A CONICAL SCREW BLENDER WITH GAS INJECTION

(75) Inventors: Win-Chin Chiang, Newburgh, IN (US); Nagendra Rangavajla, Newburgh, IN (US)

(73) Assignee: Bristol-Myers Squibb Company, Evansville, IN (US)

( * ) Notice: Subject to any disclaimer, the term of this patent is extended or adjusted under 35 U.S.C. 154(b) by 0 days.

(21) Appl. No.: 11/584,298

(22) Filed: Oct. 20, 2006

(65) Prior Publication Data

US 2008/0094934 A1 Apr. 24, 2008

(51) Int. Cl.
*B01F 13/02* (2006.01)
*B01F 7/08* (2006.01)

(52) U.S. Cl. ..... 366/102; 366/107; 366/287

(58) Field of Classification Search ..... 366/102–104, 366/107, 287; 34/179, 181–183
See application file for complete search history.

(56) References Cited

U.S. PATENT DOCUMENTS

| | | | | |
|---|---|---|---|---|
| 2,277,361 | A * | 3/1942 | Bonotto | 34/498 |
| 2,668,764 | A * | 2/1954 | Nauta | 426/474 |
| 3,775,863 | A | 12/1973 | Updegrove | |
| 3,913,238 | A | 10/1975 | Updegrove | |
| 4,123,174 | A * | 10/1978 | Titus | 366/102 |
| 5,032,399 | A | 7/1991 | Gorbach et al. | |
| 5,544,424 | A | 8/1996 | Haleen | |
| 5,709,036 | A | 1/1998 | Haleen | |
| 5,902,578 | A | 5/1999 | Halpin-Dohnalek et al. | |
| 6,500,463 | B1 | 12/2002 | Van Lengerich | |
| 6,544,568 | B2 | 4/2003 | La Droitte et al. | |
| 6,723,358 | B1 | 4/2004 | Van Lengerich | |
| 6,783,780 | B1 | 8/2004 | De Jong et al. | |
| 2003/0017192 | A1 | 1/2003 | Kanafani et al. | |
| 2003/0147857 | A1 | 8/2003 | Monte | |
| 2004/0062758 | A1 | 4/2004 | Mayra-Makinen et al. | |
| 2004/0101495 | A1 | 5/2004 | Nase et al. | |

FOREIGN PATENT DOCUMENTS

| | | |
|---|---|---|
| DE | 1204596 B | 11/1965 |
| DE | 1932094 A1 | 1/1971 |

(Continued)

OTHER PUBLICATIONS

Powder and Bulk Engineering, Jan. 1992, pp. 37-43 by Larry Hixon et al., entitled Using a Conical Screw Mixer for More Than Mixing.

(Continued)

*Primary Examiner*—Charles E Cooley
(74) *Attorney, Agent, or Firm*—Richard D. Schmidt; Bristol-Myers Squibb Co.

(57) ABSTRACT

The invention relates to a conical screw blender which comprises an inverted cone-shaped vessel. The blender also includes a material inlet, a material outlet, a driven screw housed within the vessel, and at least two non-diffuse gas injection lines attached to the vessel. The conical screw blender of the present invention can be used not only for the mixing of materials, but also for the drying of materials.

6 Claims, 5 Drawing Sheets

FOREIGN PATENT DOCUMENTS

| | | | |
|---|---|---|---|
| DE | 3343275 | A1 * | 6/1985 |
| DE | 432221 | C1 * | 8/1994 |
| DE | 10332974 | A1 | 2/2005 |

OTHER PUBLICATIONS

Journal of Engineering and Environmental Sciences, 1998, vol. 22, pp. 47-55 by Ayse çeçen Erbil entitled Prediction of the Fountain Heights in Fine Particle Spouted Bed Systems.

Biotechnology and Bioengineering, Oct. 5, 2004, vol. 88, No. 1 pp. 71-76 by Yannick Mille et al., entitled New Drying Process for Lactic Bacteria Based on Their Dehydration Behavior in Liquid Medium.

The EFSA Journal, 2004, vol. 52 pp. 1-7 entitled Opinion of the Scientific Panel on Additives and Products or Substances used in Animal Feed on the Safety of Product "MLB"0 *Lactobacillus acidophilus* for dogs.

Immunology and Cell Biology, 2000, vol. 78, pp. 80-88 by Kaila Kailasapathy et al, entitled Special Feature, Survival and therapeutic potential of probiotic organisms with reference to *Lactobacillus acidophilus* and *Bifidobacterium* spp.

Nutrition Science News, Jun. 1999, pp. 1-5 by David Wolfson entitled A Probiotics Primer. Online at http://www.newhope.com/nutritionsciencenews/NSN_backs/Jun_/nat_remedies.cfm.

Pharmaceutical and Medical Packaging News Magazine PMPN Article Index, Jul. 1999 pp. 1-5 by Annie Gorton entitled Desiccants Enhance package Performance. Online at http://www.devicelink.com/pmpn/archive/99/07/003.html.

J. Nutr., 1995, vol. 125, pp. 1401-1412 by Glenn R. Gibson et al. entitled Critical Review Dietary Modulation of the Human Colonic Microbiota: Introducing the Concept of Prebiotics.

Document by Dairy Science and Technology, Feb. 2001, entitled Dairy and Food Technology Science of Modified Atmosphere Packaging. Online at http://www.dairyscience.info/map-science.htm.

Document by National Research Development Corporation dated Jan. 7, 2005, entitled Instant Kulfi-Mix-Powder. Online at http://www.nrdcindia.com/pages/kulfimix.htm.

Current Issue in Print by Nutraceuticals World dated Mar. 25, 2005 entitled Probiotics, Prebiotics & Synbiotics & Synbiotics: Harnessing Enormous Potential.

HMBV—Mixing: Batch mixing—Centro screw mixer: Working principle dated Apr. 26, 2005. Online at http://www.hmbv.nl/english/04_01111_working_principle.asp.

Udo's Choice Product Information entitled Udo's Choice Probiotic Blends pp. 1-7. Online at http://www.udoerasmus.com/products/probiotics.htm.

Storing Dry Milks/Shelf Life of Dry Milks dated Jan. 7, 2005 pp. 1-3. Online at http://waltonfeed.com/grain/faqs/iib2.html.

Visno Engineering, Manufacturing, Maintenance dated Oct. 4, 2006 entitled Conical Mixers. Online at http://www.visno.nl/pages%20UK1.1/mixer_conical_uk.htm.

International Search Report Form PCT/ISA/210, Nov. 14, 2007.

* cited by examiner

METHOD FOR BLENDING HEAT-SENSITIVE MATERIAL USING A CONICAL SCREW BLENDER WITH GAS INJECTION

BACKGROUND OF THE INVENTION (1) Field of the Invention

The present invention relates to a conical screw blender.

(2) Description of the Related Art

In the production of many foods, beverages, and nutritional or pharmaceutical products, intermediate or final products may require substantial mixing and/or drying. It is important in these industries that the mixing and/or drying be accomplished efficiently and thoroughly without unnecessarily damaging the materials being mixed or dried. For materials that are sensitive to elements such as heat or moisture, these considerations may be particularly relevant.

For example, probiotics, which are defined as living microbial cell preparations or components of microbial cells that have a beneficial effect on the health and well being of a host, are often added to food or beverage products because they have various health benefits for consumers. Salminen S., et al., *Probiotics: How Should They Be Defined*? Trend Food Sci. Technol. 10:107-10 (1999). These health benefits may include inhibition of bacterial pathogens, reduction of colon cancer risk, stimulation of immune response, and reduction of serum cholesterol levels. In many situations, probiotics are incorporated into nutritional supplements, children's enteral products, and infant formulas.

Probiotics are adversely affected by four elements: light, heat, oxygen and moisture. Probiotic stability is achieved by minimizing these four elements during production and storage, including during the time that the probiotics are being incorporated into the nutritional or food products. Thus, mixing and drying methods for materials containing probiotics or other similar materials should attempt to eliminate light, heat, oxygen, and moisture.

Generally speaking, the mixing of materials can be accomplished in many ways. As examples, a continuous mixer or a batch mixer may be utilized. A continuous mixer is a process line vessel that is continuously fed the correct proportion of ingredients. The ingredients are quickly mixed, agitated, and discharged to the next piece of equipment in the process. A batch mixer is a stand-alone vessel in which all the ingredients are loaded, agitated until homogeneously dispersed or mixed, and then discharged. A batch mixer is well-suited to applications requiring high mixing accuracy and validation of batch-to-batch consistency. Hixon & Ruschmann, *Using a Conical Screw Mixer for More than Mixing*, Powder and Bulk Engr. 37-43 (January 1992).

One of the most versatile batch mixers is a conical screw mixer, also referred to as a vertical orbiting screw mixer or conical screw blender. These mixers can handle exclusively dry ingredients, such as powders, as well as combinations of dry and liquid ingredients, such as slurries or pastes. A conical screw mixer can be designed to handle large quantities of material while permitting accurate ingredient and additive proportioning.

A typical conical screw mixer has a vessel which is shaped like an inverted cone. A material inlet is typically located near the top of the vessel and a material outlet is typically located near the bottom of the vessel. A drive motor is often mounted on the top of the vessel and is linked to an orbital arm inside the vessel's top. A cantilevered screw is mounted onto the orbital arm. The cantilevered screw allows near-complete discharge of the vessel contents after mixing.

The screw can also be supported at the bottom of the vessel for large batches or viscous materials.

In operation, the drive motor moves the orbiting arm and, in turn, the screw around the vessel's inner wall. As the screw orbits the vessel, the screw also rotates, directing material upward.

The various movements of the materials inside the conical screw blender each contribute to its mixing effectiveness. Firstly, the screw revolves around the blender's own axis and pushes the material upward. Secondly, the orbiting arm causes the materials to be mixed in a circular motion. Lastly, the material that has been pushed upward by the screw descends slowly through the center of the vessel, mixing with the materials being moved upward by the orbiting screw. These various motions ensure thorough mixing, both vertically as well as horizontally.

While there are certain advantages to using conical screw blenders, there disadvantages as well. One major disadvantage in the use of conical screw blenders is the effect of shear force on the materials contained therein. Shear force is a force that acts parallel to a surface. When shear force acts over a certain area, it is referred to as shear stress. In a conical screw blender, gravity pulls the materials downward, creating shear stress due to the compaction of the materials. Shear stress can detrimentally damage materials within a blender, especially if any viable microorganisms are being mixed.

In addition to the shear stress created in a conical screw blender, the mixing process also generates a great deal of friction. This increased level of friction increases the temperature of the materials being mixed. This can also be detrimental to heat-sensitive materials such as probiotics.

In addition to mixing, conical blenders can also serve as drying containers for particulate and biological substrates. Several adaptations such as vacuum pumps or hot-air inlets can be added to a conical mixer in order to make it function as a drying apparatus. Vacuum pumps, however, are inherently expensive to produce, operate, and maintain and it is often difficult to control the product temperature in a vacuum dryer. Vacuum dryers also require a long time period to bring material to high degree of dryness and, thus, have not made conventional conical blenders completely acceptable as drying apparatus. Similarly disadvantageous, hot air-driven conical mixers can be detrimental to heat-sensitive materials, such as probiotics.

The prior art does not provide a conical screw blender that effectively reduces shear force and avoids the generation of friction and heat in the materials being blended. Accordingly, it would be useful to provide a conical screw blender that is useful in drying materials, while at the same time reducing shear stress and friction within the vessel.

SUMMARY OF THE INVENTION

Briefly, therefore, the present invention is directed to a conical screw blender. The blender can comprise an inverted cone-shaped vessel, a material inlet, a material outlet, a driven screw housed within the vessel, and at least two non-diffused gas injection lines attached to the vessel.

In another embodiment, the invention comprises a method for drying heat-sensitive materials. The method comprises introducing heat-sensitive materials into the blender described above, blending the heat-sensitive materials, and introducing at least two streams of a purging agent into the blender at a rate which causes the materials to form a local spouting bed motion.

Among the several advantages found to be achieved by the present invention, it dries and mixes materials while limiting the amount of shear stress, friction, and heat on those materials. The invention may be particularly effective in drying or mixing heat-sensitive materials.

BRIEF DESCRIPTION OF THE DRAWINGS

For a more complete understanding of the present invention, reference is now made to the following descriptions taken in conjunction with the accompanying drawings.

DETAILED DESCRIPTION OF THE PREFERRED EMBODIMENTS

Figure 1:
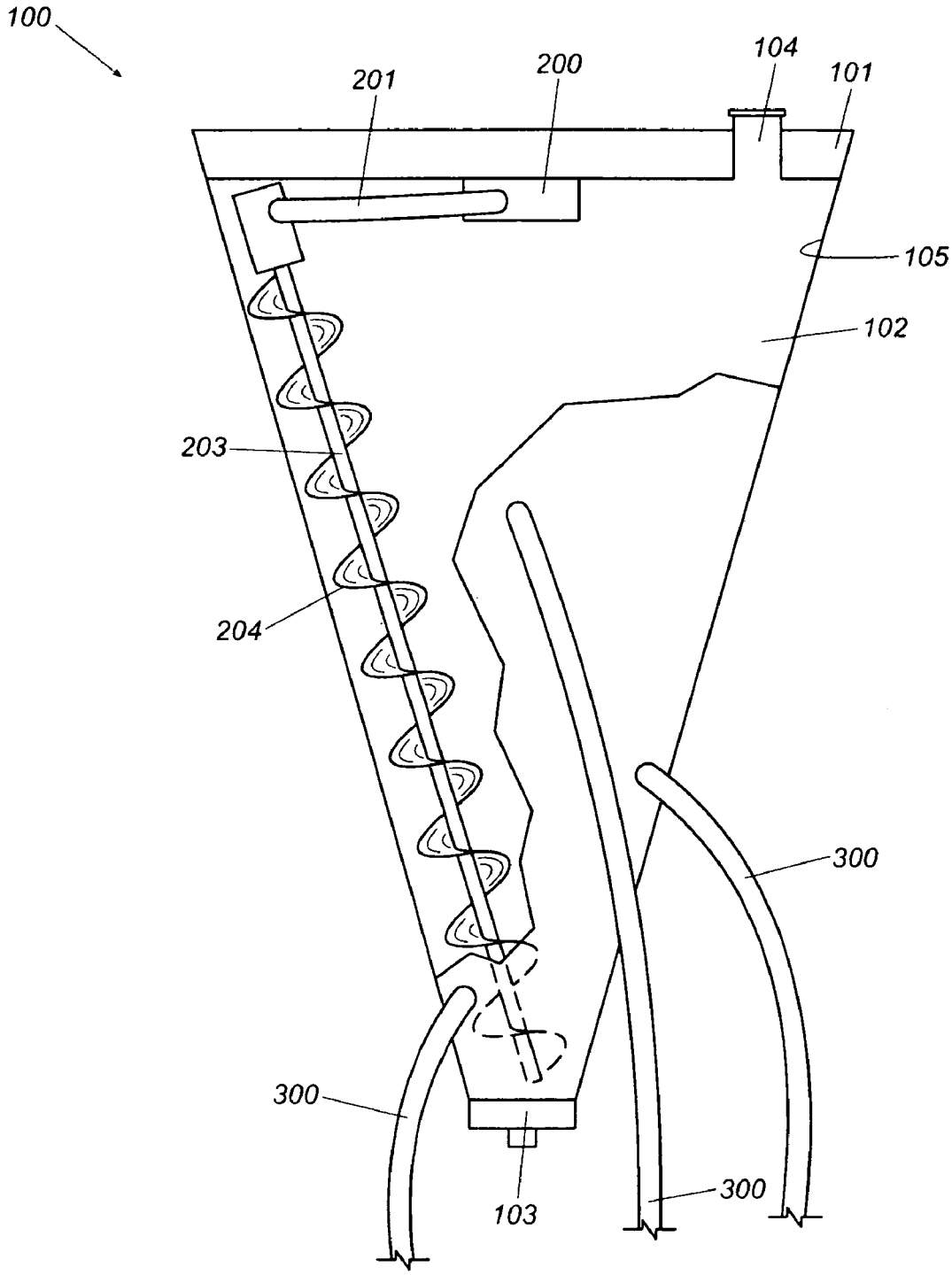
FIG. 1 illustrates a cutaway view of an embodiment of the conical screw blender wherein the screw is cantilevered.

Reference now will be made in detail to the embodiments of the invention, one or more examples of which are set forth below. Each example is provided by way of explanation of the invention, not a limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment.

Thus, it is intended that the present invention covers such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention.

The present invention relates, in an embodiment, to a conical screw blender as described herein. The conical screw blender of the present invention can be useful in the mixing or drying of materials while limiting the introduction of light, heat, oxygen, or moisture into the drying or mixing process. The invention may be particularly effective in mixing or drying heat-sensitive materials, such as probiotics.

The present invention is particularly effective due to the injection of a purging agent into the vessel during processing. Even limited exposure to oxygen may degrade various components of food, beverage, nutritional, or pharmaceutical products. For this reason, a stream of a purging agent is used in the present invention rather than an oxygen stream. The terms "purging agent" are defined as any inert gas that removes and replaces the oxygen in a contained area. Any purging agent known in the art can be utilized. In a particular embodiment, the purging agent is selected from the group consisting of nitrogen and carbon dioxide.

Because heat can also have deleterious effects on product components, the purging agent may have a low temperature in some embodiments. For example, the purging agent may enter the vessel at a temperature of below about 25° C. In other embodiments, the purging agent may enter the vessel at a temperature of below about 20° C. In still other embodiments, the purging agent may enter the vessel at a temperature of about 10° C. In further embodiments, the purging agent may enter the vessel at a temperature of about 0° C. The pressure of the purging agent may be about 1 atmosphere, but other pressures may also be useful.

The purging agent is injected into the conical blender of the present invention via at least two gas injection lines. In some embodiments, three gas injection lines are utilized.

In an embodiment, the multiple gas injection lines may be located at various heights within the vessel. In this embodiment, one gas injection line could be located at the base of the vessel, a second gas injection line located at a position which is about ⅙ of the height of the vessel, measured from the base of the vessel, and a third gas injection line located at a position which is about ⅓ of the height of the vessel, measured from the base of the vessel.

In another embodiment, the multiple gas injection lines are located at varying positions about the circumference of the blender. In a particular embodiment, the gas injection lines are located equidistant from one another.

By introducing several streams of a purging agent into a conical blender's vessel, the device becomes extremely effective in mixing, drying, reducing shear stress, reducing friction and removing oxygen from the atmosphere within the vessel. A conical screw blender having at least two gas injection lines is advantageous over a blender having only one gas injection line for several reasons.

First, the introduction of several streams of a purging agent mixes the materials in the vessel more efficiently and more effectively. In an embodiment, a first gas injection line, located at the base of the vessel, would provide an initial thrust upward, and a second and, even a third gas injection line, located at varying heights above the first gas injection line, would then propagate the materials further upward. Thus, the multiple gas injection lines can move the materials located at the bottom of the blender to a higher level far more quickly than a device having only one gas injection line. The additional gas injection lines provide the device with an additional movement dimension, which aids in mixing and drying.

Because the ingredients are being mixed more effectively, there is also a greater likelihood that each particle in the vessel is repeatedly contacted by the purging agent, thereby more effectively decreasing the moisture content of the particles. For example, in a blender having only one gas injection line, the gas injection line provides an initial thrust of the materials upward, but the particles must then depend on the action of the screw to propagate them further upward. In contrast, the present invention is able to move the materials upward via the combined actions of the screw and the multiple gas injection lines.

Secondly, the use of multiple gas injection lines reduces high packing stresses and shear stresses on the materials. Generally, the force of gravity within the blender forces materials downward and packs them together, causing stress which can damage viable microorganisms or other sensitive materials. Placing multiple gas injection lines at varying heights and positions about the circumference of the blender reduces packing and shear stresses.

Thirdly, the introduction of several streams of a purging agent effectively replaces the air in the blender and alters the gas environment into a much less aerobic environment. Many microorganisms, including probiotics, are anaerobic; therefore, the removal of oxygen from the blender may prevent the death of many viable microorganisms.

Lastly, the use of multiple gas injection lines reduces the temperature of the material. Excessive friction causes an increase in temperature inside the blender, which, in turn, may damage the viability of the materials. Thus, multiple lines of a purging agent reduce friction throughout the blender, thereby reducing the temperature in the blender and extending the shelf-life of compositions containing probiotics.

In an embodiment, the purging agent may be introduced at a rate which is sufficient to move the blending material upward and form a local spouting bed motion. Spouted bed systems have emerged as very efficient particle contactors and find many applications in the chemical and biochemical industry. In spouted bed systems, a gas is introduced in the form of a jet and causes the particles to circulate in a uniform manner.

The purging agent may be introduced at a rate of about 1 to about 10 standard cubic feet per meter (SCFM). In other embodiments, the introduction rate of purging agent may be between about 3 and about 7 SCFM. In some embodiments, the purging agent may be introduced at a rate of about 5 SCFM.

In an embodiment of the invention, the blender is not completely sealed and pressurized but is at normal atmospheric air pressure. As the purging agent enters the blender, it replaces and discharges the oxygen within the blender.

In some known conventional mixers, a porous plate is utilized between the vessel and the gas inlet to diffuse the air stream entering the mixer. Because the air stream is diffused, a spouted bed cannot form in the mixer. This decreases the efficiency of the mixing and drying process. In the present invention, the gas inlets or injection lines can be non-diffuse, meaning no porous plate is present between the injection line and the vessel. This allows the gas inlet to form spouted beds within the vessel, aiding the mixing and drying of the heat-sensitive materials.

The blender can be adapted to cool the materials contained therein by encasing the vessel in a jacket. The jacket can then be filled with a cooling medium, such as refrigerant-cooled brine. In this embodiment, any jacket known in the art can be used. For example, the jacket could be a labyrinth jacket or a split-pipe coil jacket.

Referring to the figures, the blender 100 of the present invention comprises an inverted cone-shaped vessel 102. The top of the vessel can have a cover 101 and a material inlet 104 can be located within the cover 101. A material outlet 103 can be located at or near the bottom of the vessel 102.

Figure 1A:
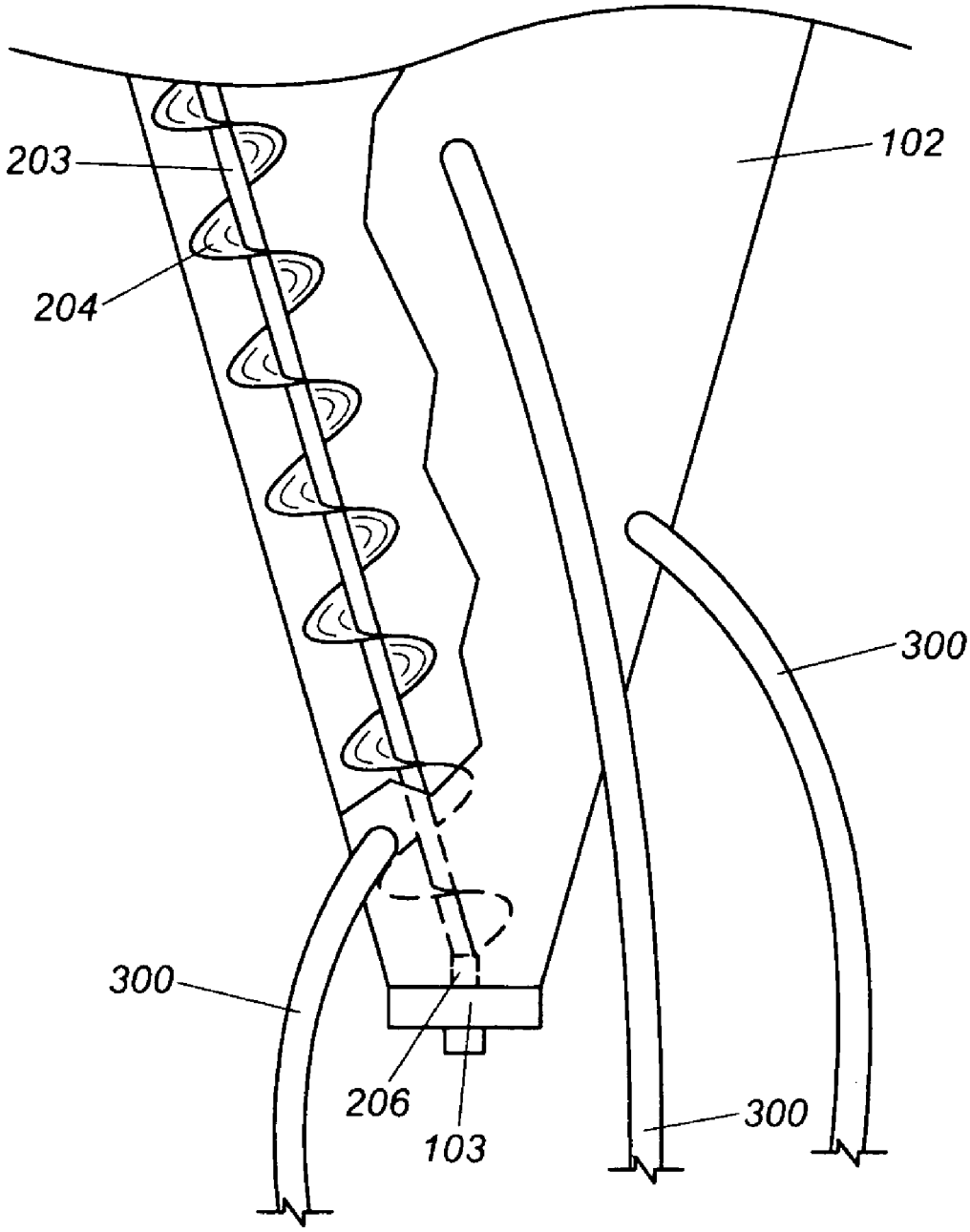
FIG. 1*a* illustrates a cutaway view of an embodiment of the conical screw blender wherein the screw is supported at the base of the vessel.
Figure 2:
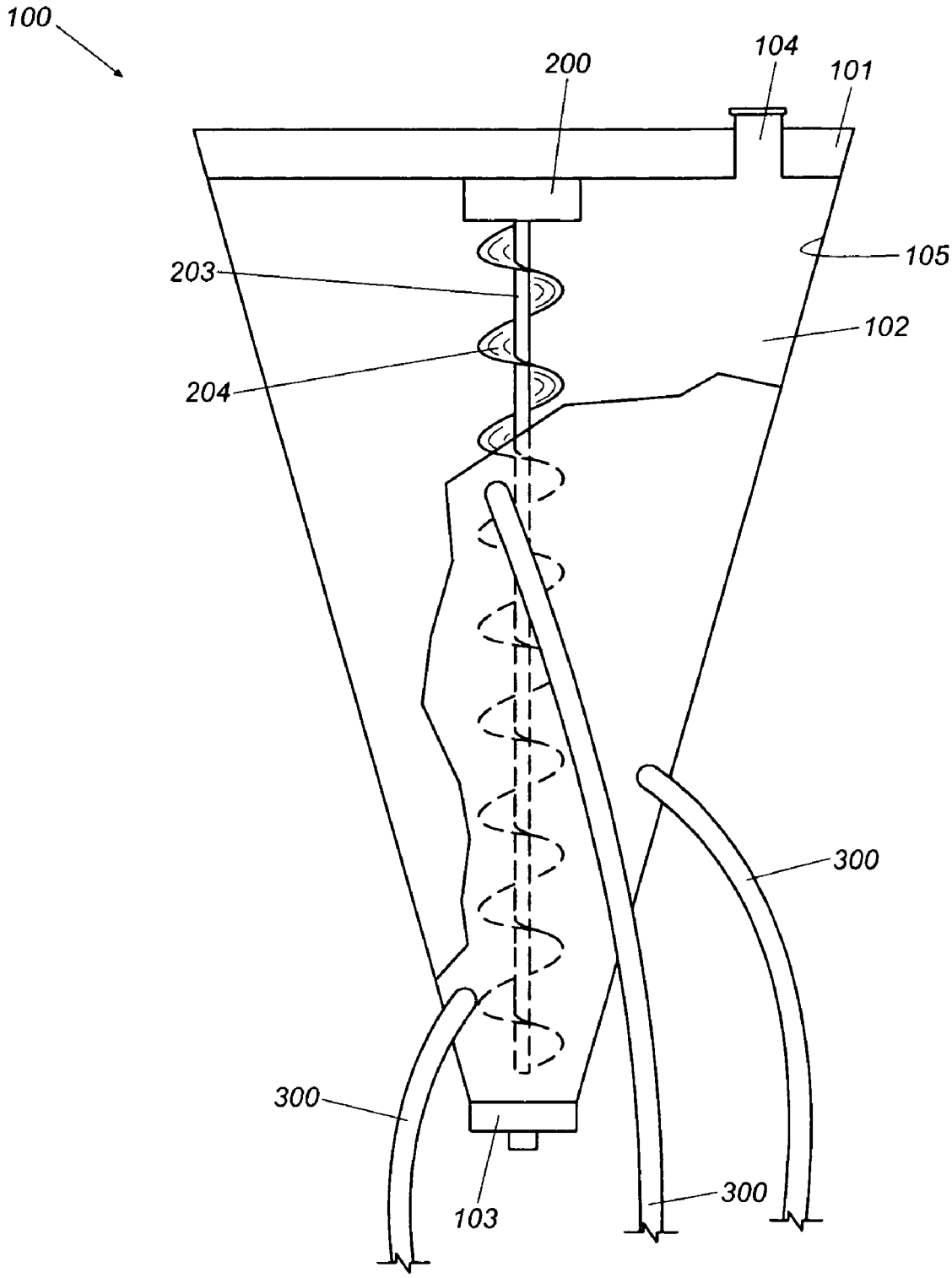
FIG. 2 illustrates a cutaway view of an embodiment of the conical screw blender wherein the screw is connected directly to the drive mechanism and is positioned vertically within the vessel.

A drive mechanism 200, which can be any mechanism known in the art to drive an orbital arm, screw, or ribbon, may be located within the vessel 102. More specifically, the drive mechanism 200 may be anchored to the cover 101 or the upper portion of the vessel 102. The drive mechanism may be connected to a first end of an orbital arm 201. A second end of the orbital arm 201 may be connected to a screw 203, providing a cantilevered mount for the screw 203 (shown in FIG. 1). In other embodiments, the drive mechanism 200 may be connected directly to the screw 203 (shown in FIG. 2). The screw 203 may have helical blades 204. In an embodiment, the screw 203 may have a supporting mechanism 206 connecting it to the bottom of the vessel 102 (shown in FIG. 1*a*). The supporting mechanism 206 may be any mechanism that can support the screw 203 by connecting the screw 203 to the base of the vessel 102 and allowing the screw 203 to rotate about its axis and about the circumference of the vessel 102.

Figure 3:
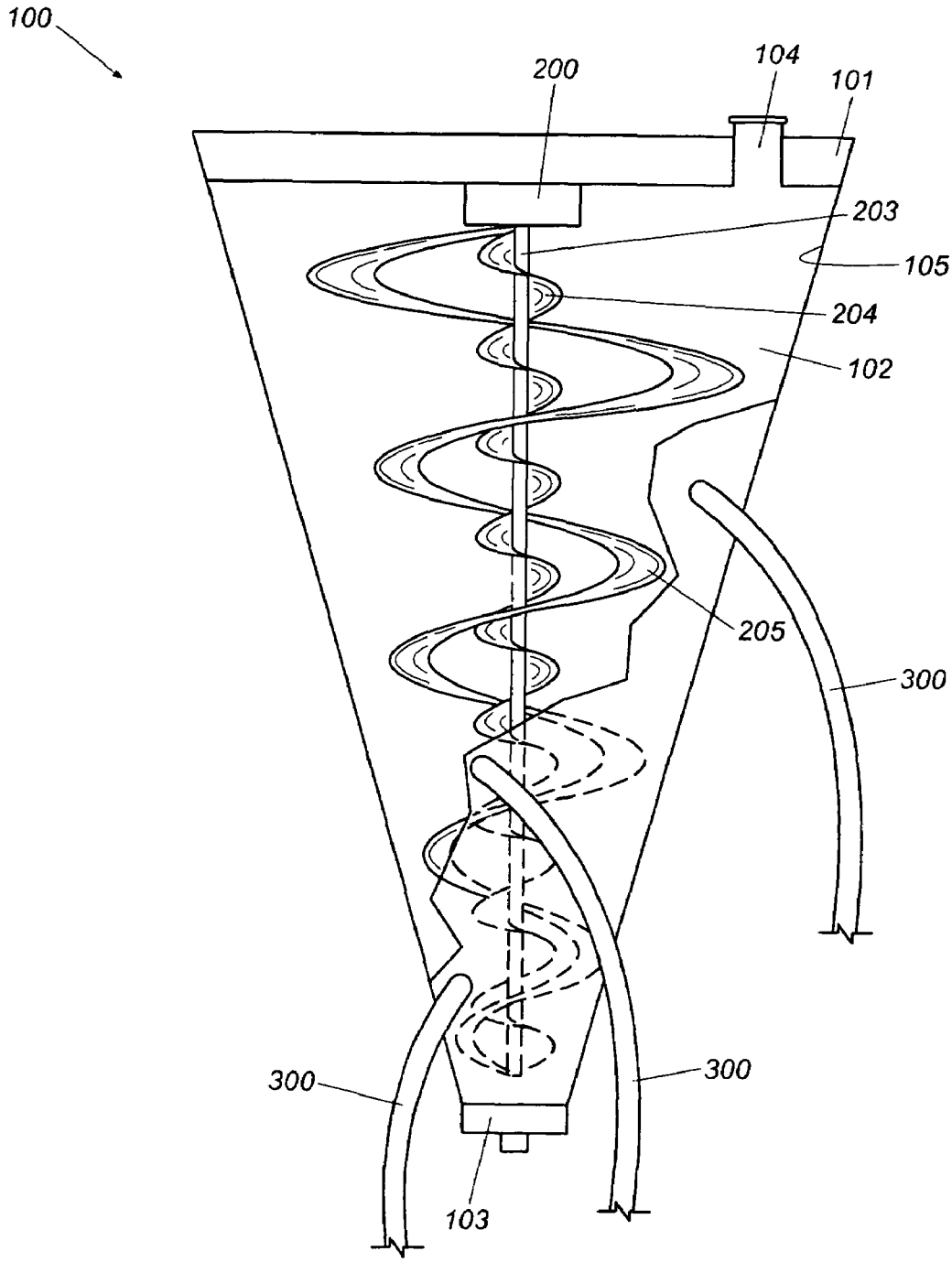
FIG. 3 illustrates a cutaway view of an embodiment of the conical screw blender wherein the vessel contains a screw and a ribbon, both of which are positioned vertically within the vessel.

In other embodiments, the vessel 102 may contain a screw 203 and a ribbon 205 (shown in FIG. 3). In this embodiment, the ribbon 205 may be connected to the drive mechanism 200. It may rotate about the axis of the screw 203, providing an additional mixing and drying dimension.

At least two gas injection lines 300 are connected to the vessel 102 and can inject a purging agent into the interior of the vessel 102. In some embodiments, three gas injection lines 300 are present. As discussed above, the gas injection lines 300 may be located at various heights within the vessel 102. In the embodiment shown in FIG. 1, one gas injection line is located at the base of the vessel 102, a second gas injection line located at a position which is about ⅙ of the height of the vessel 102, measured from the base of the vessel 102, and a third gas injection line is located at a position which is about ⅓ of the height of the vessel 102, measured from the base of the vessel 102. Also shown in FIG. 1, the gas injection lines 300 can be located at varying positions about the circumference of the vessel 102.

In various embodiments, the gas injection lines 300 contain a mechanism that prevents them from clogging with the materials being mixed or dried within the vessel 102. In one embodiment, a butterfly valve is located within the gas injection lines 300 near the inner surface 105 of the vessel 102. The butterfly valve may prevent the ingress of materials contained within the vessel. A butterfly valve is a flow control device, used in this embodiment to make a gas start or stop flowing through the gas injection lines 300.

The vessel 102 can be constructed from any material known in the art to be able to withstand the processing conditions necessary for the materials being mixed or dried. In an embodiment, the vessel 102 comprises steel. In this embodiment, the vessel 102 can comprise mild steel or varying grades of stainless steel.

The gas injection lines 300 may be constructed any material known in the art to be able to withstand the processing conditions necessary for the materials being mixed or dried. In one embodiment, the material can be rubber or a suitable polymer.

To use the device of the present invention, the cover 101 may be removed and various materials may be loaded into the vessel 102. The cover 101 should then be replaced on the vessel 102. In the alternative, materials may be added to the vessel 102 via the material inlet 104.

To initiate the mixing process, the drive mechanism 200 should be activated. The drive mechanism 200 may then move the orbital arm 201, which, in turn, orbits the screw 203 around the vessel's inner wall 105. As the screw 203 orbits the vessel 102, the helical blades 204 of the screw 203 also rotate about the axis of the screw 203, directing the material contained within the vessel 201 upward.

To aid in the mixing process and initiate the drying process, the gas injection lines 300 may then be pressurized and opened, forcing a purging agent into the vessel 102. The various actions of the orbiting and rotating screw 203 and the gas injection lines 300, which can be located at varying heights and positions about the circumference of the vessel 102, then initiate and propagate the efficient mixing and drying of the materials. During the mixing and/or drying process, additional ingredients or materials may be added to the vessel 102 via the material inlet 104.

Once the materials are sufficiently mixed and/or dried, the material may be removed from the vessel 102 via the material outlet 103. The drive mechanism 200 may continue to operate to assist in removing the materials from the vessel 102. If desired, the gas injection lines 300 may also continue to inject a purging agent into the vessel 102 during the material removal process.

Figure 4:
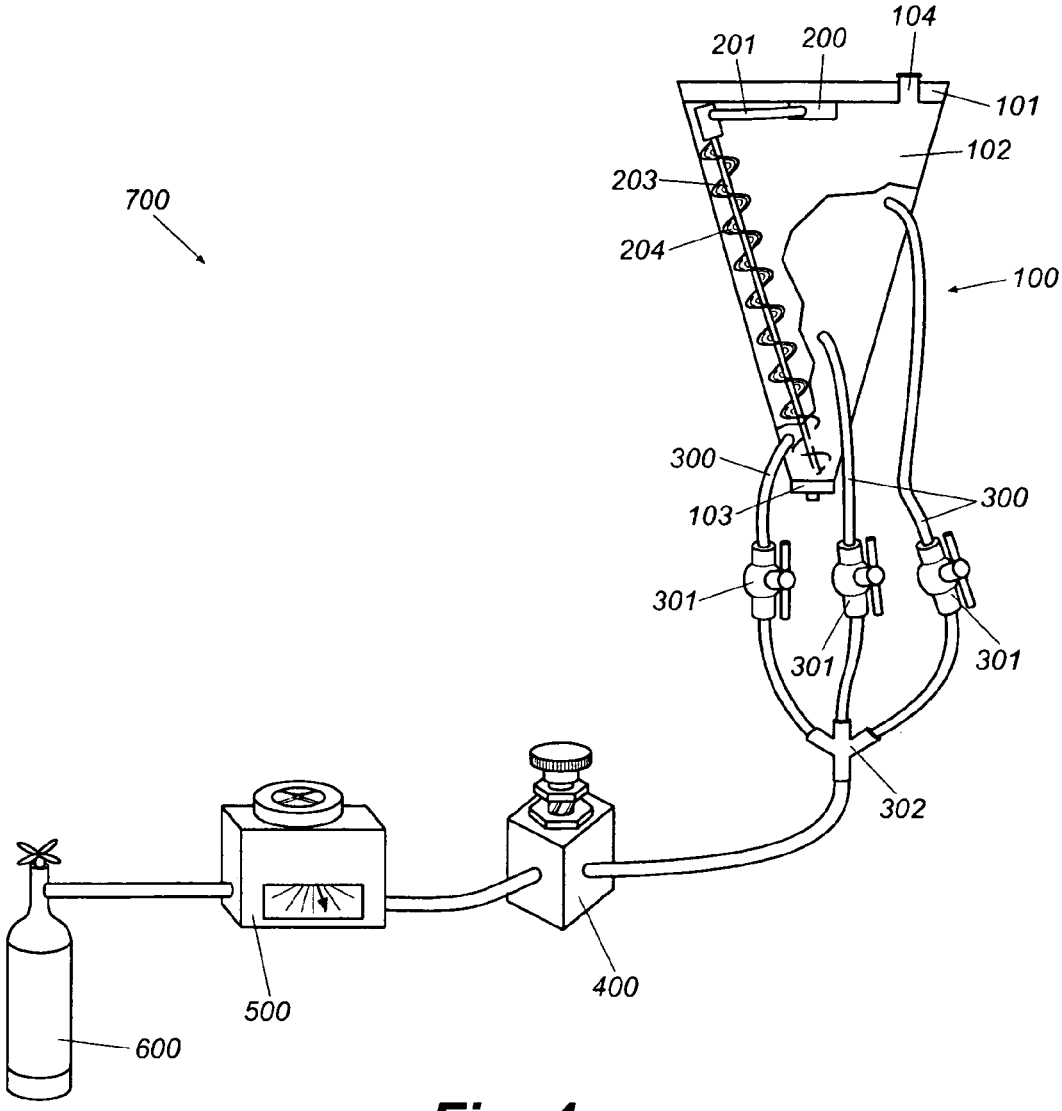
FIG. 4 illustrates a partial cutaway view of an embodiment of a conical screw blender assembly.

As shown in FIG. 4, the present invention is also directed, in an embodiment, to a conical screw blender assembly 700. The conical screw blender assembly 700 may comprise a blender 100 as described above. The assembly 700 may also comprise ball valves 301 located on each gas injection line 300, near the entrance of the gas injection line 300 into the vessel 102. The assembly 700 may also comprise a junction 302 that joins the gas injection lines 300 into one single line. This single line may be connected to a pressure regulator 400, flowmeter 500, and tank 600 which contains a purging agent.

Example 1

This example illustrates the mixing and drying of a probiotic-containing infant formula. The cover of the vessel was removed and 1000 kg of Nutramigen® powder base was added to the vessel. The component ingredients of Nutramigen® powder base are listed in Table 1. The Nutramigen® powder base contained approximately 2.0% moisture.

TABLE 1

Component Ingredients of Nutramigen ® Powder Base

| Ingredient, unit | Per 100 kg base |
|---|---|
| Corn Syrup Solids, kg | 43.135 |
| Palm Olein Oil, kg | 16.2 |
| Modified Corn Starch, kg | 16.143 |
| Coconut Oil, kg | 7.2 |
| Soy Oil, kg | 7.2 |
| High Oleic Sunflower Oil, kg | 5.4 |
| Calcium Phosphate Dibasic, kg | 2.286 |
| Potassium Citrate, kg | 0.87 |
| Potassium Chloride, kg | 0.66 |
| Calcium Citrate, kg | 0.614 |
| Choline Chloride, kg | 0.154 |
| Magnesium Oxide Light, kg | 0.118 |
| L-Carnitine, g | 19.8 |
| Sodium Iodide, g | 0.119 |

The vessel cover was then replaced and the drive mechanism was activated. The gas injection lines were connected to a pressurized nitrogen tank and nitrogen gas was injected into the vessel at a rate of about 5 SCFM. Then, 175 kg of corn syrup solids was added to the vessel while the drive mechanism and gas injection lines were in operation. The corn syrup solids contained approximately 1.7% moisture. After that, 240 kg of protein hydrolysate was added to the vessel via the material inlet. The protein hydrolysate contained 2.1% moisture. After the above ingredients were added to the blender, an amount of *Lactobacillus* GG was added to the vessel in order to prepare a final mixture containing about $6.25\times10^8$ cfu/g product. The ingredients were blended for approximately 15 minutes. The drive mechanism and gas injection lines were then turned off. The material outlet was opened and the final mixture exited the vessel. The moisture content and water activity of the mixture were then measured at ambient conditions using an AquaLab Water Activity meter. The moisture content of the mixture was determined to be 2.0% and the water activity was determined to be about 0.14.

All references cited in this specification, including without limitation, all papers, publications, patents, patent applications, presentations, texts, reports, manuscripts, brochures, books, internet postings, journal articles, periodicals, and the like, are hereby incorporated by reference into this specification in their entireties. The discussion of the references herein is intended merely to summarize the assertions made by their authors and no admission is made that any reference constitutes prior art. Applicants reserve the right to challenge the accuracy and pertinence of the cited references.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part. For example, while methods for the production of a commercially sterile liquid nutritional supplement made according to those methods have been exemplified, other uses are contemplated. Therefore, the spirit and scope of the appended claims should not be limited to the description of the preferred versions contained therein.

The invention claimed is:

1. A method for drying heat-sensitive materials comprising:

a.) introducing at least one heat-sensitive material and at least one other material into a conical screw blender wherein said blender comprises:

i. an inverted cone-shaped vessel;

ii. a material inlet in the vessel;

iii. a material outlet located at or near the bottom of the vessel;

iv. a driven screw housed within the vessel; and v. at least two non-diffused gas injection lines attached to the vessel and adapted to inject an inert purging agent into the vessel, wherein at least one gas injection line is located near the base of the vessel, and said gas injection lines act to reduce shearing stress of the driven screw on a material introduced through said material inlet and to displace atmospheric oxygen from within said vessel;

b.) blending the at least one heat-sensitive material and other material; and c.) introducing at least two streams of an inert purging agent into the blender at a rate which causes the materials to form a local spouting bed motion, wherein the purging agent is selected from the group consisting of nitrogen gas and carbon dioxide gas.

2. The method according to claim 1 wherein the purging agent is introduced at a rate of between about 3 and 7 SCFM.

3. The method according to claim 1, wherein the purging agent is introduced at a rate of about 5 SCFM.

4. The method according to claim 1, wherein the purging agent is introduced at a temperature below about 25° C.

5. The method according to claim 1, wherein the purging agent is introduced at a temperature of about 10° C.

6. The method according to claim 1 wherein the purging agent is introduced at a temperature of about 0° C.

* * * * *